US008201904B2

(12) United States Patent
Vesanto et al.

(10) Patent No.: US 8,201,904 B2
(45) Date of Patent: Jun. 19, 2012

(54) METHOD AND A PRINTING MACHINE FOR MANUFACTURING PRINTED BOARD CONTAINERS

(75) Inventors: Risto Vesanto, Imatra (FI); Kaj Backfolk, Imatra (FI); Ville Laalo, Imatra (FI); Bo Sundqvist, Imatra (FI); Noora Nylander, Lahti (FI); Panu Tanninen, Rauha (FI); Mika Aunola, Imatra (FI)

(73) Assignee: Stora Enso OYJ, Helsinki (FI)

( * ) Notice: Subject to any disclaimer, the term of this patent is extended or adjusted under 35 U.S.C. 154(b) by 273 days.

(21) Appl. No.: 12/530,977

(22) PCT Filed: Mar. 27, 2008

(86) PCT No.: PCT/FI2008/050141

§ 371 (c)(1),
(2), (4) Date: Dec. 8, 2009

(87) PCT Pub. No.: WO2008/116973

PCT Pub. Date: Oct. 2, 2008

(65) Prior Publication Data

US 2010/0091054 A1 Apr. 15, 2010

(30) Foreign Application Priority Data

Mar. 27, 2007 (FI) ..... 20070246

(51) Int. Cl.
*B41J 3/00* (2006.01)
*B41J 29/38* (2006.01)
*B41J 2/015* (2006.01)

(52) U.S. Cl. ..... 347/9; 347/4; 347/5; 347/20

(58) Field of Classification Search ..... 347/9, 4–5, 347/20
See application file for complete search history.

(56) References Cited

U.S. PATENT DOCUMENTS 2,885,957 A 5/1959 Hansen
3,977,318 A 8/1976 Cohan
4,805,758 A 2/1989 Dominico et al.
5,076,433 A * 12/1991 Howes ..... 206/459.5
(Continued)

FOREIGN PATENT DOCUMENTS

EP 0 209 896 A2 1/1987
(Continued)

*Primary Examiner* — Jason Uhlenhake
(74) *Attorney, Agent, or Firm* — Birch, Stewart, Kolasch & Birch, LLP

(57) ABSTRACT

The invention relates to a method of providing board containers (V) with prints and a printing machine that applies the method. According to the invention, the printing machine comprises a turret head (2), with uniformly spaced radial arms (3) diverging from its rotational axis, each arm ending in a mandrel (4) that carries a container (1); and stationary stations (5, 6, 8) that are located on the path of the turret head for gripping a container, printing it by a printhead (7, 13), and removing the printed container (V). At the printing station (6), the container (1) is digital-printed by the printhead (7), past which the surface of the container is conveyed by means of a rotational motion. The container can be a conical drinking cup (1), which is ink-jet printed by the stationary printhead (7) by rotating the cup by 360° by means of the mandrel (4) that is pushed inside the cup. The cups (1) can be produced at a plant in mass-scale production runs and divided into smaller lots, which are delivered to customers and which the customers then print according to their own individual needs.

15 Claims, 4 Drawing Sheets

Figure 1:
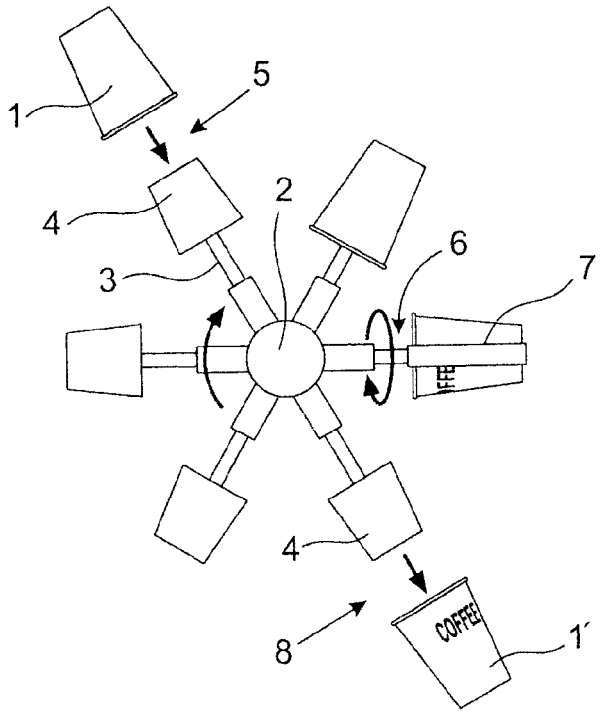

U.S. PATENT DOCUMENTS 6,164,199 A 12/2000 Dubuit et al.

FOREIGN PATENT DOCUMENTS

| | | | | |
|---|---|---|---|---|
| EP | 1 225 053 | A2 | | 7/2002 |
| EP | 1225053 | A2 | * | 7/2002 |
| JP | 2001-160177 | A | | 6/2001 |
| JP | 2003-123140 | A | | 4/2003 |
| JP | 2003-132421 | A | | 5/2003 |
| JP | 2003132421 | A | * | 5/2003 |
| WO | WO-91/10595 | A1 | | 7/1991 |
| WO | WO-97/27053 | A1 | | 7/1997 |
| WO | WO-02/09942 | A1 | | 2/2002 |

* cited by examiner

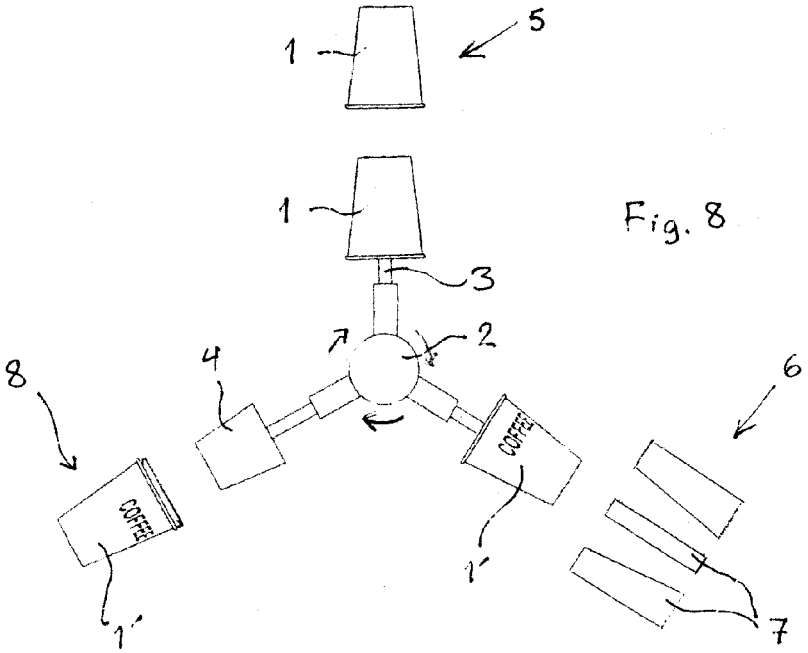
Fig. 8
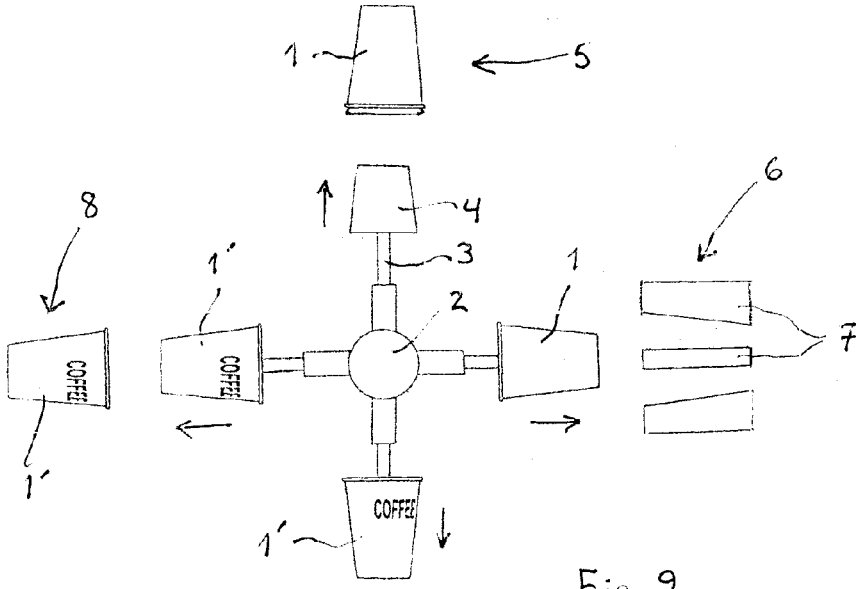
Fig. 9
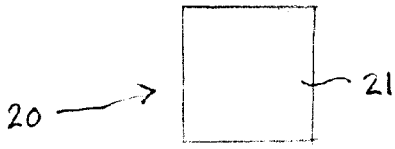

METHOD AND A PRINTING MACHINE FOR MANUFACTURING PRINTED BOARD CONTAINERS

The invention relates to a printing machine and a method of providing board containers with prints. The printing machine comprises at least one digital printing head, past which the mantle surface of the container that is to be printed can be conveyed by a rotational motion of a mandrel that is inside the container.

On a mass scale, board cups are manufactured as disposable drinking cups, in particular. In addition, the board cups or containers can be used, among others, as packages of foodstuffs, such as yoghurt, sour whole milk, and desserts and sweets, which can be closed with a cover. The sides of the containers are mostly provided with prints, which can give information about the packaged product or comprise other commercial, promotional or decorative prints.

At present, board containers provided with prints, such as drinking cups, are manufactured by printing board, which is conveyed from a roll, by flexographic or gravure printing, the board being rewound after the printing. The next stage of operation comprises cutting the blanks, which form the cup bodies, from a web. The cutter can consist of a slitting roller that is against the web, or a punching knife that moves in a reciprocating manner. The cut blanks are stacked and the rest of the web becomes waste. The stack of blanks is transferred to a cupping machine, which generally folds the blank into a frusto-conical cup mantle, seams it along with a round bottom to form a finished cup, which is provided with a curled mouth. The cups that can be placed within each other are stored up in stacks to be delivered to customers.

Such a manufacturing process of printed board containers, such as drinking cups, is suitable for large-scale mass production of cups, wherein the production runs consisting of mutually similar cups are long, comprising hundreds of thousands of cups or more. In such long production runs, the manufacturing costs per cup are low. Instead, for shorter production runs of less than 50 000 cups, the technology is slow, and the costs per cup are high.

In the packaging technology, it is generally also well-known to print packaging blanks that have been cut. Publication WO02/09942 A1 describes such a process, wherein the printing is carried out by digital printing. Publication WO91/10595 describes a similar process, wherein printing the blank can be followed by folding the blank into a package without a new intermediate stacking thereof. In publication WO97/27053, the digital printing of a moving web of packaging material is connected to a packaging machine, which manufactures the packages from the web and, thereafter, fills them up and closes them. Furthermore, the publication describes the ink-jet printing of finished packing cases and the printing of plastic bottles using a roller, which transfers the ink sprayed by the printhead to the side of the bottle.

Publications EP 209 896 and EP 1 225 053 further disclose a printing technique of cylindrical or conical containers, wherein the container is rotated past the ink-jet printing heads that surround the same. The containers are carried by a disc-like support perpendicular to the same, and they are brought to one or more printing stations by rotating the support. In publication EP 1 225 053, moving printheads are brought around the conical container by moving them axially with respect to the container (cf. FIG. 1 of the publication) or perpendicularly, i.e., in the direction of the support (cf. FIG. 3 of the publication).

However, moving the printheads for mutually positioning them and the container in the manners described in publication EP 1 225 053 is a solution disadvantageous to the accuracy of the positioning and the sharpness of the print. In particular, if there are more than one printheads at the printing station, mechanically attached to each other, they must be moved so that the support and the container carried by it can rotate. If, again, the printheads are separate, the larger number of moving parts further impedes the accurate mutual positioning thereof. Using the disc-like support also means that the feeding, printing, and removing members of the containers that are to be printed should be adapted side by side, and the making direction of the containers should be turned by 180°, which may cause problems, considering the use of space.

The purpose of the present invention is to improve the technique disclosed in publication EP 1 225 053 so that the problems mentioned above can be avoided. In particular, the purpose is to provide a solution, wherein the digital printheads are stationary and only the containers that are to be printed move with respect to the printheads. The printing machine according to the invention is characterized in comprising a turret head, with uniformly spaced radial arms diverging from its rotational axis, each one of them ending in a mandrel that carries a container; and stationary stations that are located on the path of the turret head for gripping a container, printing it by means of the printhead, and removing the printed container.

At its simplest, the printing machine according to the invention can comprise three work stations for gripping, printing, and removing the container, and being spaced at intervals of 120° on the circumference of the turret head. If the printing station is followed by a drying station, the four work stations are spaced at intervals of 90° on the circumference of the turret head. This means that the direction of travel of the containers in the machine turns by 90° or 120°, which is easy to arrange for the use of space. Neither are the stationary printheads of the printing station on the way, impeding the said arrangement of material flows.

According to a particularly advantageous embodiment of the invention, the mandrels are arranged so as to move in the longitudinal direction of the arms, and the longitudinal reciprocating motions of the mandrels are synchronized with each other to keep the turret head continuously in balance. Among others, the solution renders possible the several stationary printheads of the printing station that are required by the multi-colour printing, and the mandrel and the container to be printed that is on the mandrel can be pushed inside the circumference formed by the printheads. To move the mandrels, the arms can be rendered so as to extend and retract telescopically. Alternatively, the mandrels can be arranged to move on the arms beyond their respective axial length, so that they can be taken to the work stations and retracted from them, whereby they allow the turret head to be rotated to the next stage of operation.

Alternatively, multi-colour printing can be implemented at most printing stations, which are placed on the path of the turret head and which print different colours. When needed, each printing station can be followed by a drying station on the circumference of the turret head for drying the printing ink.

In the invention, when instead of the web or the blanks, board containers that are already folded and seamed are printed, the advantages of the mass production of containers can be maintained. In other words, the containers can be produced at the plant in production lots of, e.g., 100 000 to 1 000 000, which are broken up into smaller lots of, e.g., 100 to 50 000, preferably 200 to 5000 for printing. In the digital printing technique, wherein producing, replacing or modifying the print is easy, the printing costs of even shorter production runs are low. In addition, the digital print, i.e., the text, graphics or images that are printed onto the side of the board container, can be changed in the middle of the printing process of the production run. Thus, the containers included in the production run can be numbered, for example, or they can differ from each other individually in some other way. The invention is best applied so that the customer or the packager of the final product receives the unprinted containers from the plant and then takes care of the printing according to their own needs. For example, typical users of printed drinking cups include cafés, fast food restaurants, athletic competitions, trade fairs, and other public events. The users of printed and closable board containers, in turn, include the confectionery and food industries.

Because of the printing technique that is based on the rotational motion of the container, the board container to be printed is preferably a rotationally symmetrical, particularly, frusto-conical cup or container. In the invention, the most preferable digital printing technique comprises ink-jet printing by a stationary printhead, past which the body of the container is arranged to rotate. When the printhead and the container body do not touch each other in the ink-jet printing, no problems are caused by the vertical seam of the body to the printing. The dry toner technique is also suitable for the invention in cases, where the printing does not extend to the vertical seam of the body.

The method of providing board containers with prints according to the invention, comprising the digital printing of the containers by one or more printheads, past which the mantle surface of the container to be printed is conveyed by a rotational motion of the mandrel inside the container, is characterized in that, in connection with the printing, the containers are moved continuously from one station to another by a turret head, with uniformly spaced radial arms diverging from its rotational axis and ending in a mandrel, whereby the container is gripped by a mandrel at the feeding station, the container is printed at a following printing station on the path of the turret head, and the printed container is removed from the mandrel on the path at a subsequent removing station, whereafter the mandrel released from the container returns to the feeding station for a new working cycle.

The invention further comprises a method, wherein board containers, such as frusto-conical drinking cups, are produced at a plant in mass-scale production runs that are divided into lots, which are transferred to outlets outside the plant, wherein the containers are digital-printed according to the above, so that the prints that are made at the various outlets are mutually different. In that case, it is possible for the containers leaving the plant to comprise a common pre-print in the lots that go to the various outlets or even in all the containers produced, whereby the outlets outside the plant take care of complementing the print according to the respective use of the containers.

Figure 2:
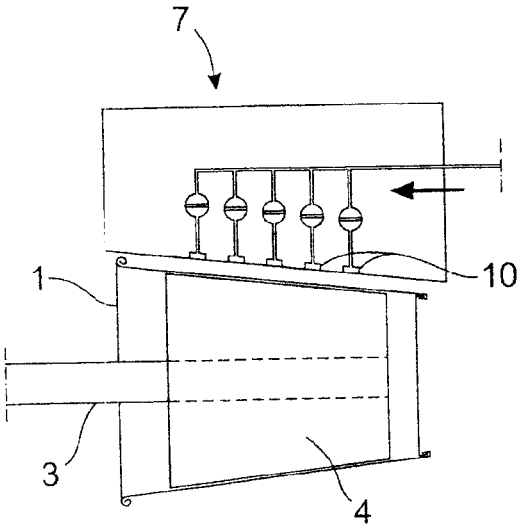
Figure 3:
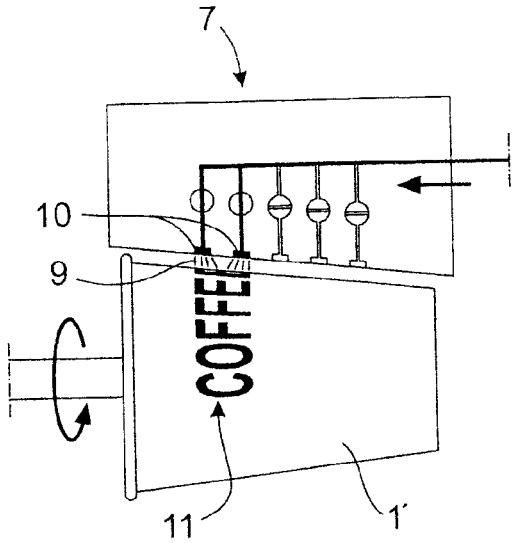
Figure 4:
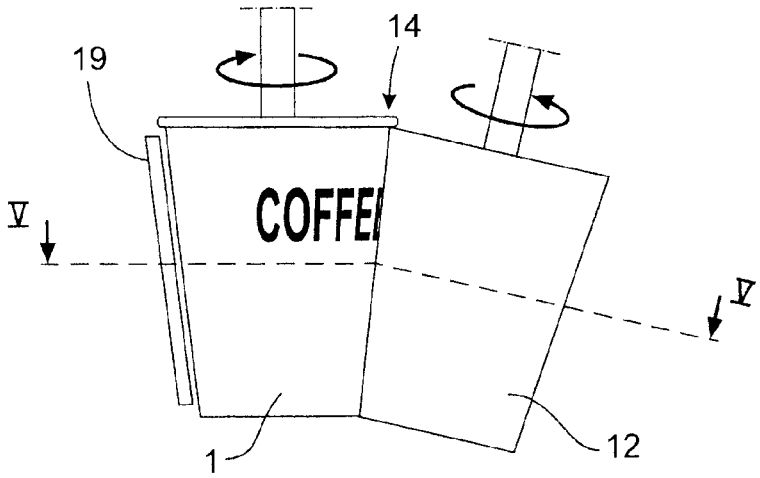
Figure 5:
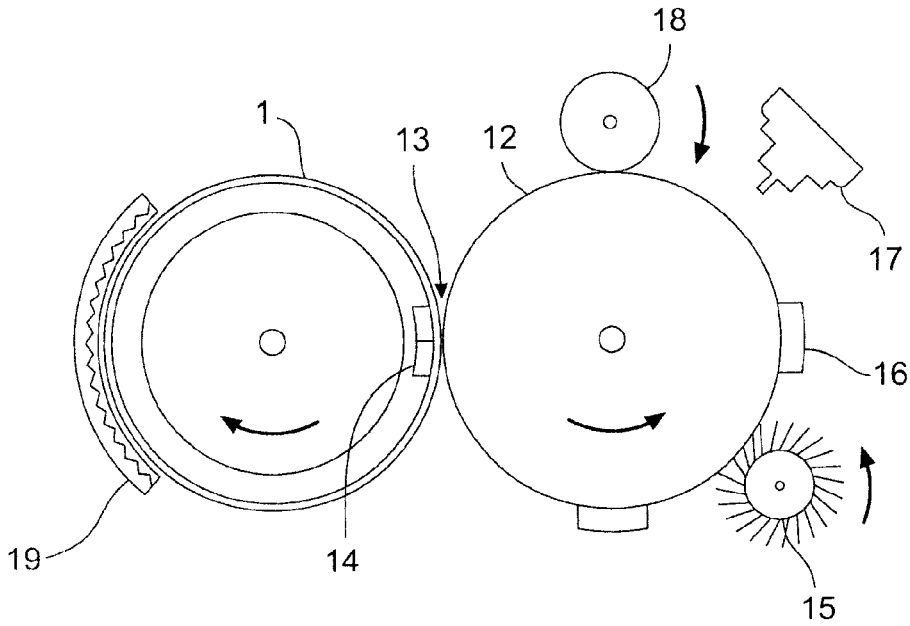
Figure 6:
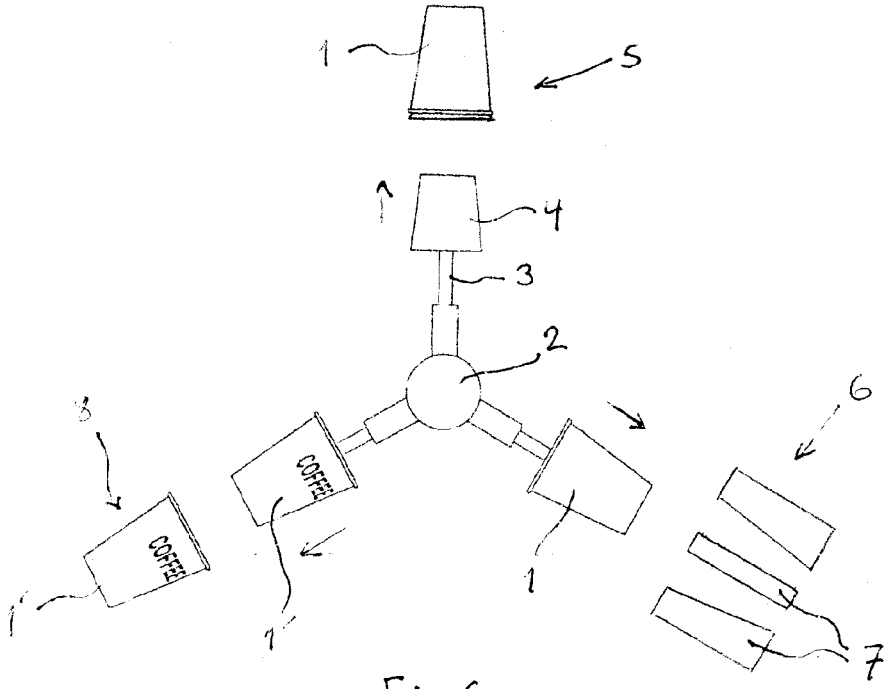
Figure 7:
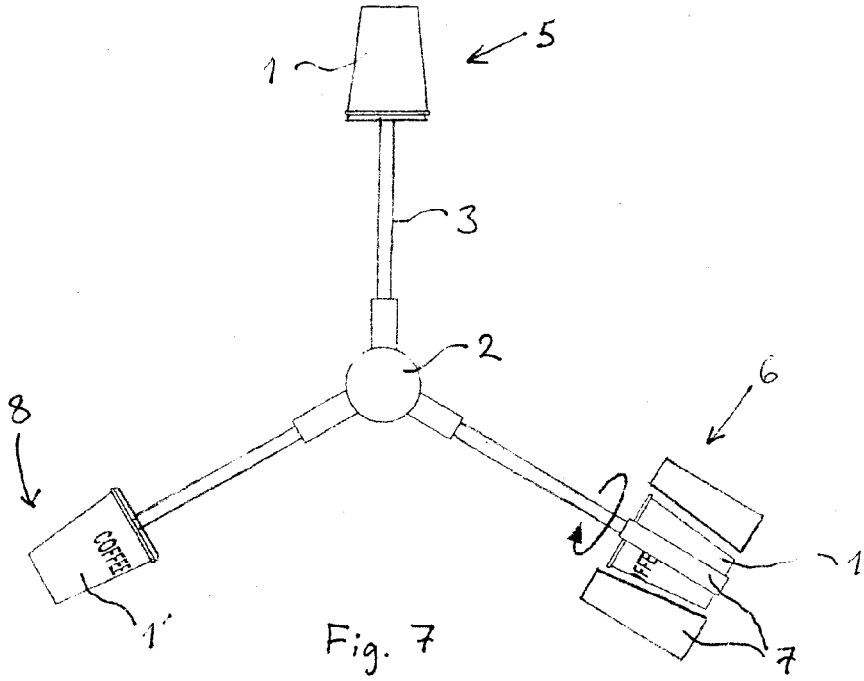

In the following, the invention is described in detail by means of examples and with reference to the appended drawings, wherein FIG. 1 shows the digital printing of board cups according to the invention by means of the turret head of the printing machine, comprising conical mandrels, FIGS. 2 and 3 show printing by the ink-jet printhead in the printing process according to FIG. 1, FIG. 4 shows the electrostatic printing of a board cup by a dry toner in the digital printing machine comprising a conical drum, FIG. 5 is the section V-V of FIG. 4, FIG. 6 shows the turret head of the printing machine, according to another embodiment of the invention, with its work stations at the beginning of a working cycle, after the turret head has turned by 120°, FIG. 7 shows the turret head at the second stage of the working cycle, wherein the telescopic arms have pushed the mandrels to the work stations for retrieving, printing, and removing the printed container, FIG. 8 shows the turret head at the third stage of the working cycle, wherein the arms have pulled the mandrels to their starting positions for the rotation of the turret head and for returning to the beginning of the working cycle, and FIG. 9 shows, corresponding to FIG. 6, the turret head of the printing machine with its work stations, according to a third embodiment of the invention.

FIGS. 1 to 3 show the ink-jet printing of polymer-coated board drinking cups 1, which have been seamed and provided with a curled mouth, by a turret head 2 that belongs to the digital printing machine. The turret head 2 comprises frusto-conical mandrels 4, which are supported by radial arms 3 and have a shape similar to that of the cups, each one of them being rotatable around its arm 3. Unprinted cups 1 are brought to the printing machine, stacked within each other and, at the feeding station 5, they are fed to the rotating turret head 2 so that the mandrel 4 goes inside the cup, respectively. The turret head 2 transfers the mandrel and the cup carried by the same to the printing station 6, where the cup is printed by the stationary ink-jet printhead 7, while the cup rotates around the axis formed by the arm 3 of the mandrel 4. Thereafter, the printed cup 1' with its mandrel is transferred to the removing station 8, where the cup is disengaged from the mandrel 4. The location of the feeding and removing stations 5, 8 on the same line enables a linear travel of the cups in the printing machine.

The mantle surface of the cup 1 to be printed and the ink-jet printhead 7 of the printing station are shown inside views in FIGS. 2 and 3. The arm 3 of the mandrel 4 forms the spin axis of the conical cup 1, and the printhead 7 is placed on the side of the cup at a short distance from the cup mantle, so that the ink-jets 9 from the ink nozzles 10 of the printhead are mainly directed perpendicularly to the axis of the cup. The ink nozzles 10 are spaced uniformly along the entire length of the body, but in the case shown, only the two uppermost ones are used. The print 11 formed by the ink is generated during the rotational motion of the cup. After the ink has dried, the printing surface can be covered with lacquer, when so desired, possibly at a different work station on the path of the turret head 2.

The digital printing of drinking cups 1, 1' according to the description is preferably carried out in connection with the application of the cups, wherein the production runs that are printed are small, respectively; for example, from a few hundreds to a few thousands of cups. The unprinted cups or the cups that are possibly provided with pre-prints are manufactured at the plant on a mass scale, providing the advantages of mass production. These cups are delivered in the quantities ordered to different customers, who then print the cups according to the above, each according to their own individual needs. Producing the prints by the digital printing machine is easy, and the print can be changed even in the middle of the production run without interrupting the process, so that the cups of the run are printed in different ways. Thus, the cups can be, for example, numbered or differentiated by some other principle.

FIGS. 4 and 5 show the electrostatic printing of the board drinking cup 1 with a dry toner by means of the conical drum 12 that belongs to the printing machine and is similar to the cup, the cup having been coated with polymer, such as low density polyethylene (LDPE) or ethylene methyl acrylate copolymer (EMA). During printing, the cup 1 to be printed and the drum 12 are rotated so that their mantles, at least in the area to be printed, are in contact with each other. The contact line between the cup 1 and the drum 12 forms an image transfer station 13, wherein the charged toner particles are transferred in an electric field from the drum to the polymer-coated mantle surface of the cup, which is reversely charged. To provide the electric field that transfers the toner particles, the conical retainer pushed inside the cup is provided with a coronization device 14 that rotates around the cup mantle.

A discharger (not shown) is placed on the output side of the nip between the cup 1 and the drum 12, preventing the cup mantle from adhering to the drum. When rotating, the drum 12 passes by a scraper 15, which brushes any excess toner particles off the drum, an electric charger 16, a printhead 17, which forms a latent image by selectively removing some of the charge on the drum, corresponding to the desired print, and a latent image developer 18, which adheres the electrically charged dry toner to the charged areas of the drum. Thus, the dry toner particles become adhered to the surface of the drum 12, corresponding to the desired print, and are transferred to the mantle surface of the cup 1 in the electric field of the image transfer station 13.

After the image transfer station 13, the body of the cup 1 with the toner particles, which have adhered thereto, rotates to a fixing station 19, wherein the polymer coating of the cup is melted by infrared radiation, so that the toner particles melt into the cup's mantle surface. If the toner particles contain a carrier polymer, it can also melt at the fixing stage of the print. After the IR melting, the mantle surface is cooled so that the molten polymer solidifies, stabilizing the print formed by the toner. After fixing, the printed mantle surface can further be covered with lacquer (not shown).

During the printing of cup 1, the cup with its retainer and the drum 12 of the printing machine rotate about a full cycle (360°). After this, the cup is replaced, whereby the cup retainer is drawn or rotated off the drum 12. In the meantime, it is not necessary to interrupt the rotational motion of the drum.

In principle, the embodiment of the invention according to FIGS. 6 to 8 corresponds to the one shown in FIGS. 1 to 3, except that the arms 3 of the mandrels 4 extend and retract telescopically and that the printing station 6 comprises four stationary ink-jet printheads 7, which are circumferentially spaced and intended for printing the different colours required by multi-colour printing. Each ink-jet printhead 7 can be according to FIGS. 2 and 3. On the circumference of the turret head 2, there are three uniformly spaced work stations 5, 6, 8, wherein the mandrel 4 retrieves from a stack the cup 1 that is to be printed, takes it to be printed by the printheads 7, and removes the printed cup 1' to another stack. FIG. 6 shows the starting position of a working cycle, wherein the arms 3 of mandrels 4 are retracted. The mandrel next to the feeding station 5 is bare, the mandrel next to the printing station 6 carries an unprinted cup, and the mandrel next to the removing station 8 carries a printed cup. In FIG. 7, the arms 3 have extended simultaneously, each arm to the same extent and, along with it, the mandrels have been pushed to the work stations. From the feeding station 5, the mandrel retrieves an unprinted cup; at the printing station 6, the mandrel with its cup rotates around its own axis and the cup is printed by the ink-jet printheads surrounding the same; and at the removing station 8, the mandrel pushes the printed cup to the stack. In FIG. 8, wherein the arms 3 have retracted, the unprinted cup has been retrieved from the feeding station 5, the printed cup has been retracted from the printing station 6, and the mandrel that left the printed cup at the removing station 8 is bare. After this, the turret head 2 rotates by 120°, i.e., each arm and mandrel are transferred to the next work station, whereby the situation is again according to FIG. 6. In continuous use, the printing speed calculated is about 180 cups/min.

The embodiment according to FIG. 9 differs from the one shown in FIGS. 6 to 8 only in that, on the circumference of the turret head 2, between the printing and removing stations 6, 8, there is a fourth work station 20 for drying the printing ink. In this case, the mutual spaces between the work stations 5, 6, 20, and 8 are 90°. As at the other stations, the mandrel 4 and the printed cup on it are also taken to and from the drying station 20 by a reciprocating motion of the arm 3. In the figure, the drying station 20 comprises a drying chamber 21 that is heated, even though drying by means of, for example, radiation is also possible.

Within the invention, there can be several printing stations 6, as well as subsequent drying stations 20, on the circumference of the turret head 2, to print different colours at different stations, for example. The stations are uniformly spaced, respectively, and the telescopic arm carries out a standard reciprocating motion at each station to keep the turret head in balance.

In addition to the drinking cups, according to the invention, closable board product packages can be printed before they are filled or in connection with the filling or closing thereof.

It is obvious to those skilled in the art that the various embodiments of the invention are not limited to the examples described above, but can vary within the following claims.

The invention claimed is:

1. A printing machine for providing board containers with prints, comprising at least one digital printhead, past which the mantle surface of the container to be printed can be conveyed by rotational motion of a mandrel inside the container, wherein the printing machine comprises a turret head, with uniformly spaced radial arms diverging from its rotational axis, each arm ending in a mandrel that carries a container; and stationary stations that are located on the path of the turret head for gripping a container, printing it by the printhead, and removing the printed container, wherein the mandrels are arranged to move in the longitudinal direction of the arms and that the longitudinal, reciprocating motions of the mandrels are synchronized with each other to keep the turret head continuously in balance.

2. A printing for providing board containers with prints, comprising at least one digital printhead, past which the mantle surface of the container to be printed can be conveyed by rotational motion of a mandrel inside the container, wherein the printing machine comprises a turret head, with uniformly spaced radial arms diverging from its rotational axis, each arm ending in a mandrel that carries a container; and stationary stations that are located on the path of the turret head for gripping a container, printing it by the printhead, and removing the printed container, wherein to move the mandrels, the arms have been rendered telescopically extendable and retractable.

3. A printing machine according to claim 1 or 2, wherein on the path of the turret head, there are several printing stations and, possibly, subsequent drying stations.

4. A printing machine according to claim 1, wherein the printhead is an ink jet printhead.

5. A printing machine according to claim 1, wherein the container to be printed is a conically widening cup or container.

6. A printing machine according to claim 5, wherein the container to be printed is a frusto-conical disposable drinking cup.

7. A printing machine according to claim 1 or 2, wherein at the printing station, there are several circumferentially arranged stationary printheads for printing different colours.

8. A method of providing board containers with prints, comprising the steps of: digitally-printing the containers by one or more printheads, past which the mantle surface of the container to be printed is conveyed by the rotational motion of a mandrel inside the container, wherein in connection with the printing, the containers are continuously moved from one station to another by means of a turret head, with uniformly spaced radial arms diverging from its rotational axis and ending in a mandrel, whereby the mandrel grips the container at a feeding station, the container is printed on the path of the turret head at a following printing station, and the printed container is removed from the mandrel on the path at a subsequent removing station, whereafter the mandrel that is released from the container returns to the feeding station for a new working cycle, wherein at each station, the mandrel carries out a reciprocating motion in the longitudinal direction of the arm, and that the longitudinal motions of the mandrels at the different stations are synchronized with each other to keep the turret head continuously in balance.

9. A method according to claim 8, wherein on the path of the turret head, there are several printing stations and, possibly, subsequent drying stations.

10. A method according to claim 8, wherein the container to be printed is a frusto-conical drinking cup.

11. A method according to claim 8, wherein the printing comprises ink jet printing.

12. A method according to claim 8, wherein the printing is carried out in continuous runs, wherein the printing is changed from one container to another.

13. A method of providing board containers with prints, wherein the containers are digital-printed by one or more printheads, past which the mantle surface of the container to be printed is conveyed by the rotational motion of a mandrel inside the container, wherein in connection with the printing, the containers are continuously moved from one station to another by means of a turret head, with uniformly spaced radial arms diverging from its rotational axis and ending in a mandrel, whereby the mandrel grins the container at a feeding station, the container is printed on the path of the turret head at a following printing station, and the printed container is removed from the mandrel on the path at a subsequent removing station, whereafter the mandrel that is released from the container returns to the feeding station for a new working cycle, wherein in the reciprocating motion of the mandrel, the arm extends and retracts telescopically.

14. A method of manufacturing printed board containers, comprising the steps of: producing the containers at a plant in runs that are divided into lots, which are transferred to outlets outside the plant, digitally-printing containers by a method according to claim 8, the prints in the different outlets being different from each other.

15. A method according to claim 14, wherein the containers leaving the plant are pre-printed, and that, in the outlets outside the plant, a complementing printing of the containers is carried out.

* * * * *